US007815153B2

(12) United States Patent
Campbell et al.

(10) Patent No.: US 7,815,153 B2
(45) Date of Patent: Oct. 19, 2010

(54) LEAF CATCHER

(76) Inventors: Nickie S. Campbell, 4715 W. 90th St. South, Tulsa, OK (US) 74132; Bobbie L. Gore, 4727 W. 90th St. South, Tulsa, OK (US) 74132; Carolyn S. Gore, 4727 W. 90th St. South, Tulsa, OK (US) 74132

( * ) Notice: Subject to any disclaimer, the term of this patent is extended or adjusted under 35 U.S.C. 154(b) by 630 days.

(21) Appl. No.: 11/246,374

(22) Filed: Oct. 7, 2005

(65) Prior Publication Data

US 2007/0095419 A1 May 3, 2007

(51) Int. Cl.
*B65B 67/04* (2006.01)

(52) U.S. Cl. ..... 248/99; 248/95

(58) Field of Classification Search ..... 248/99, 248/100, 101; 141/314, 327, 313, 328, 337, 141/340, 390; 15/257.3, 257.1
See application file for complete search history.

(56) References Cited

U.S. PATENT DOCUMENTS

| | | | | | |
|---|---|---|---|---|---|
| 296,135 | A | * | 4/1884 | Cole | 248/100 |
| 1,088,633 | A | * | 2/1914 | Simmons | 141/312 |
| 2,100,888 | A | * | 11/1937 | Vine | 141/337 |
| 2,902,705 | A | * | 9/1959 | Eistrup | 15/1.7 |
| 4,186,546 | A | | 2/1980 | Machado et al. | 56/202 |
| D309,966 | S | | 8/1990 | Bishop | D34/5 |
| 5,031,277 | A | * | 7/1991 | Coker | 15/257.3 |
| 5,090,756 | A | | 2/1992 | Pfisterer | |
| 5,107,666 | A | | 4/1992 | Rahtican | 56/202 |
| 5,129,609 | A | | 7/1992 | Tobin | 248/97 |
| 5,163,278 | A | | 11/1992 | Martenhoff et al. | 56/473.5 |
| 5,207,425 | A | * | 5/1993 | Cohrs | 273/148 R |
| 5,271,589 | A | | 12/1993 | Belous | 248/97 |
| D361,185 | S | | 8/1995 | Seiler et al. | D34/5 |
| D376,237 | S | | 12/1996 | Hayes, Sr. et al. | D34/6 |
| 5,593,117 | A | * | 1/1997 | Alexander, III | 248/99 |
| 5,673,544 | A | | 10/1997 | Voigt | 56/202 |
| D401,027 | S | | 11/1998 | Mueller | D34/6 |
| 5,927,356 | A | * | 7/1999 | Henderson | 141/391 |
| 6,082,574 | A | | 7/2000 | Johnson | |
| 6,202,718 | B1 | | 3/2001 | Innocenti | 141/391 |
| 6,318,419 | B1 | | 11/2001 | Lee | 141/108 |
| 6,450,461 | B1 | | 9/2002 | Lohmann | 248/99 |
| 6,460,200 | B1 | * | 10/2002 | Mottale et al. | 4/144.4 |
| 6,708,742 | B2 | | 3/2004 | Weathers et al. | 141/391 |
| 6,938,860 | B2 | * | 9/2005 | Singleton | 248/99 |
| 7,219,705 | B2 | * | 5/2007 | Wallek | 141/340 |
| 2002/0100844 | A1 | | 8/2002 | Green | 248/99 |
| 2004/0197031 | A1 | | 10/2004 | Torick | 383/102 |
| 2005/0025397 | A1 | | 2/2005 | Zhao | 383/102 |

* cited by examiner

*Primary Examiner*—Amy J Sterling

(57) ABSTRACT

A device for funneling leaves into a bag, preferably used in conjunction with a leaf blower. The device includes a plurality of panels that define a passageway and two forwardly extending arms that define an intake area adjacent an entrance to the passageway. A bag is removably affixed adjacent to the exit of the passageway for receiving leaves and other objects blown therethrough. A ramp in the passageway induces circulating airflow in the bag. Additionally, the arms induce a corkscrew airflow and facilitate improved performance in directing objects through the passageway. The plurality of panels that make up the leaf catcher are preferably collapsible into a substantially flat configuration for ease of transport and storage. Further, the construction of the leaf catcher enables easy set up and take down when manipulating the panels from a folded to a operational configuration and vice versa.

5 Claims, 5 Drawing Sheets

LEAF CATCHER

FIELD OF THE INVENTION

This invention relates generally to a device for funneling objects, such as leaves, into a bag. More particularly, the invention relates to a collapsible device to assist a user in bagging leaves in a quick and efficient manner.

BACKGROUND OF THE INVENTION

The collection of leaves and other debris from a yard or other land is tedious and time consuming. Various methods are typically employed to gather the leaves in a manageable area for transferring the leaves into a bag or waste can.

Numerous devices have been proposed for the collection of trash, leaves and other refuse. Some of the proposed devices employ a scoop or receiving section coupled to a bag or collection member. Examples of these types of devices include U.S. Pat. No. 5,107,666 to Rahtican for "Lawn Scoop"; U.S. Pat. No. 5,031,277 to Coker for "Debris Collecting and Bagging Apparatus"; U.S. Pat. No. D309,966 to Bishop for "Trash Bag Funnel"; U.S. Pat. No. D361,185 to Seiler et al., for "Bag Support Insert with Funnel Top"; U.S. Pat. No. D376,237 to Hayes, Sr. et al., for "Leaf Bagging Accessory for Use with Drawstring Leaf Bags"; U.S. Pat. No. 6,3118,419 to Lee for "Collection System and Method"; and U.S. Pat. No. 6,708,742 to Weathers et al. for "Leaf and Debris Chute".

None of the above patents, however, teach features for enhancing the airflow through a passageway and into a collection bag. Instead, when used with a leaf blower that expels high velocity air flows for directing leaves and other debris, performance of the above devices may be diminished due to turbulent airflow, which tends to allow leaves to escape the device rather than direct the leaves into the collection receptacle. Additionally, many of the above devices are not collapsible. Consequently, such devices are inconvenient for a typical homeowner, whose storage space may be limited.

SUMMARY OF THE INVENTION

It is desirable to provide a collapsible device for efficiently funneling objects, such as leaves, into a bag. The device preferably includes a plurality of panels defining a passageway having an entrance and an exit. A support structure is provided that engages at least one of said plurality of panels defining said passageway. A first forwardly extending arm and a second forwardly extending arm are also preferably constructed of a plurality of panels that are affixed to the panels that define the passageway. The forwardly extending arms define an intake area adjacent said entrance to passageway. Inside surfaces of the first and second forwardly extending arms, which are adjacent to the intake area, are each substantially recessed at predetermined angles about a horizontal axis and define an inwardly pointed apex. Preferably, leaves or other objects are directed into the intake area with a leaf blower. The unique shape of the forwardly extending arms and associated panels that define the intake area result in advantageous airflow patterns that smoothly direct objects into the passageway.

A bag having a plurality of openings therein, e.g. a mesh bag, is removably affixed adjacent to the exit of the passageway. The bag is provided to collect objects passing through the passageway and to allow air to escape through openings in said bag. The plurality of panels that define the passageway preferably includes an upwardly angled lower panel configured such that the entrance to the passageway is larger than the exit of the passageway. The upwardly angled lower panel directs debris to an upper portion of the rear of the bag. Once openings in the rear of the bag are covered by debris, a circulation pattern develops wherein debris flows from back to front along a bottom of the bag before re-entering the high velocity airstream passing through the passageway. The result is a tendency not to clog the passageway with debris.

The plurality of panels that make up the leaf catcher are preferably collapsible into a substantially flat configuration for ease of transport and storage. Further, the construction of the leaf catcher enables easy set up and take down when manipulating the panels from a folded to a operational configuration and vice versa.

DESCRIPTION OF THE PREFERRED EMBODIMENTS

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 3:
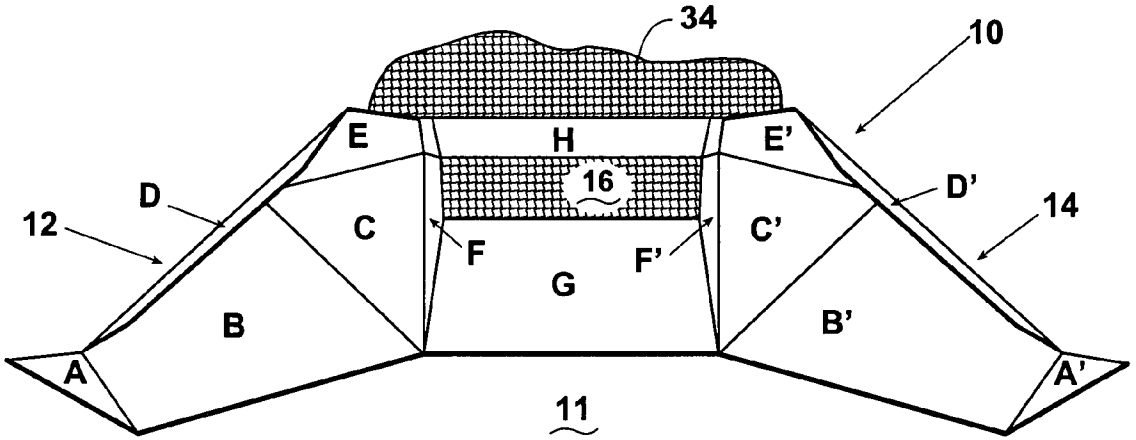
FIG. 3 is a front elevation view of the leaf catcher of FIG. 1.
Figure 4:
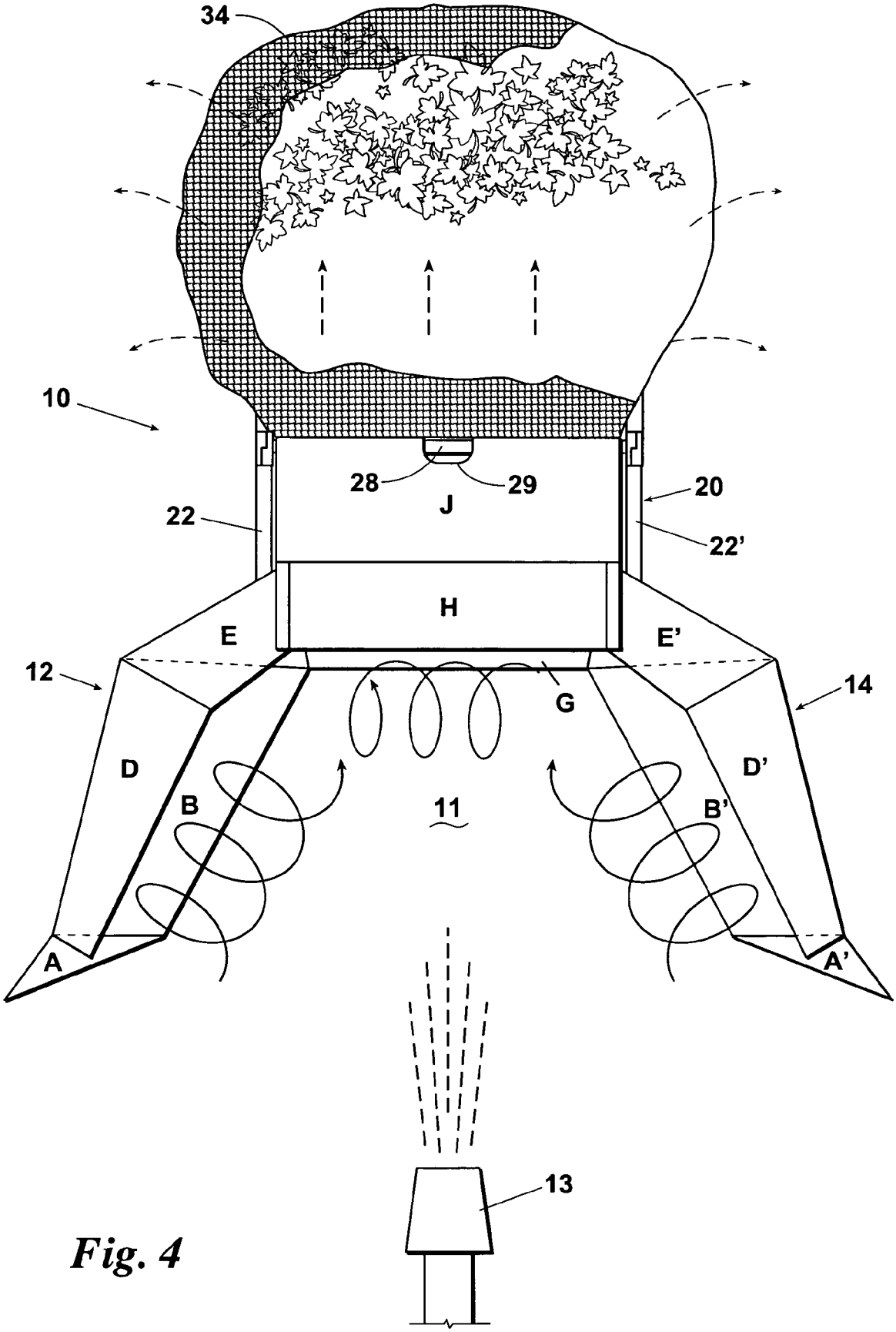
FIG. 4 is a plan view of the leaf catcher of FIG. 1.
Figure 5:
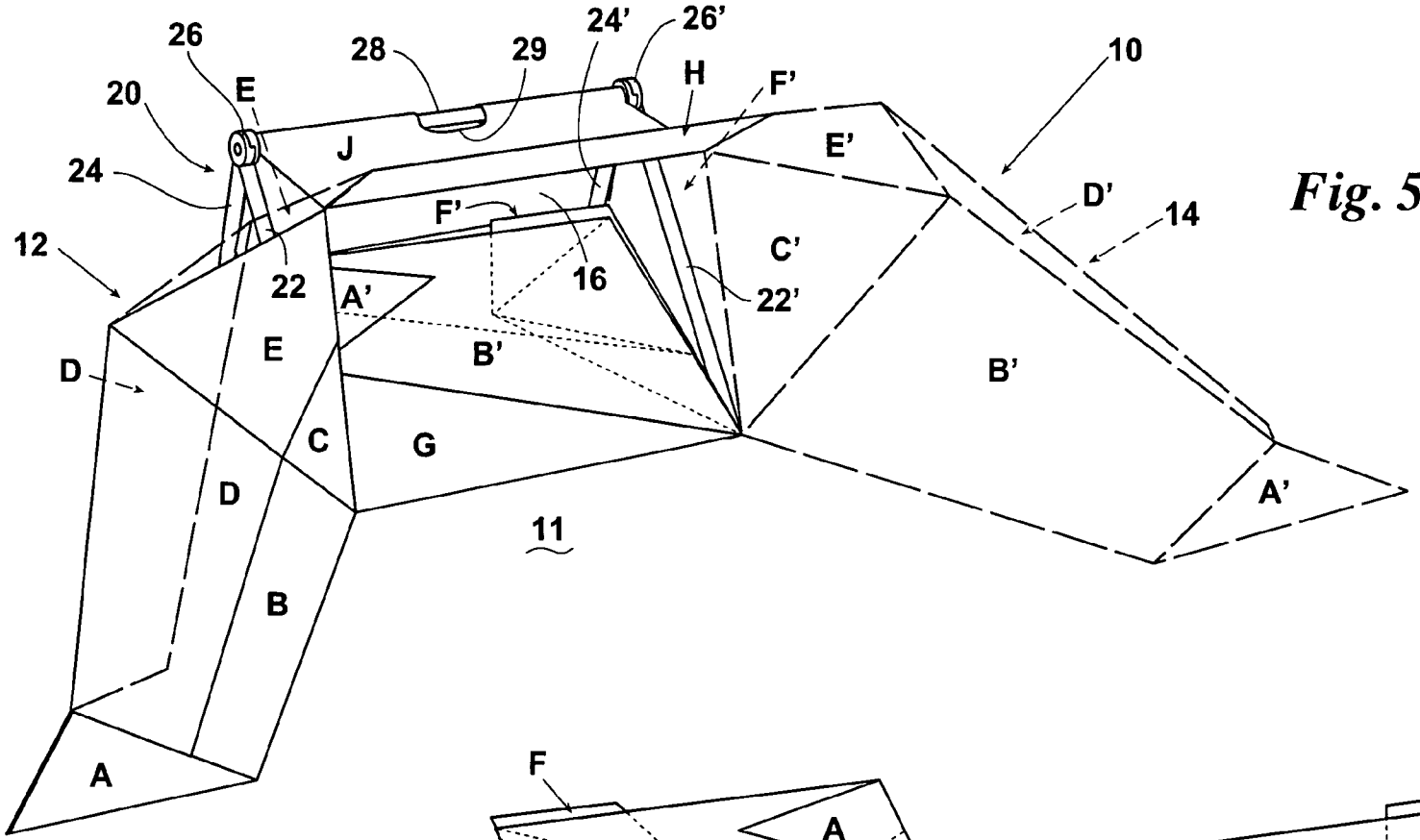
FIG. 5 is a perspective view of the leaf catcher of FIG. 1 wherein the right side is shown with phantom lines so that support structures are visible.
Figure 6:
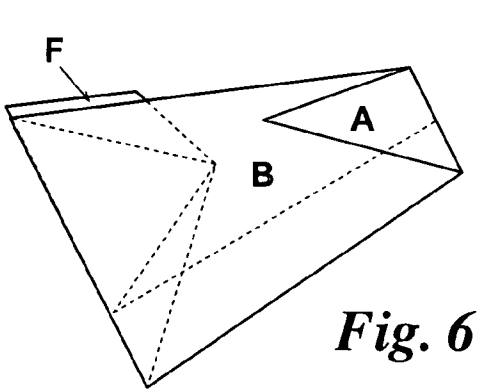
FIG. 6 is a perspective view of the left side folding section of the leaf catcher of FIG. 1, shown in a collapsed configuration.
Figure 7:
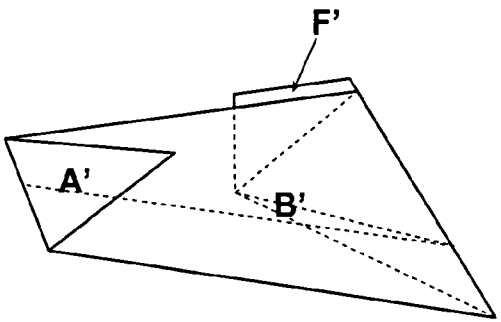
FIG. 7 is a perspective view of the right side folding section of the leaf catcher of FIG. 1, shown in a collapsed configuration.
Figure 9:
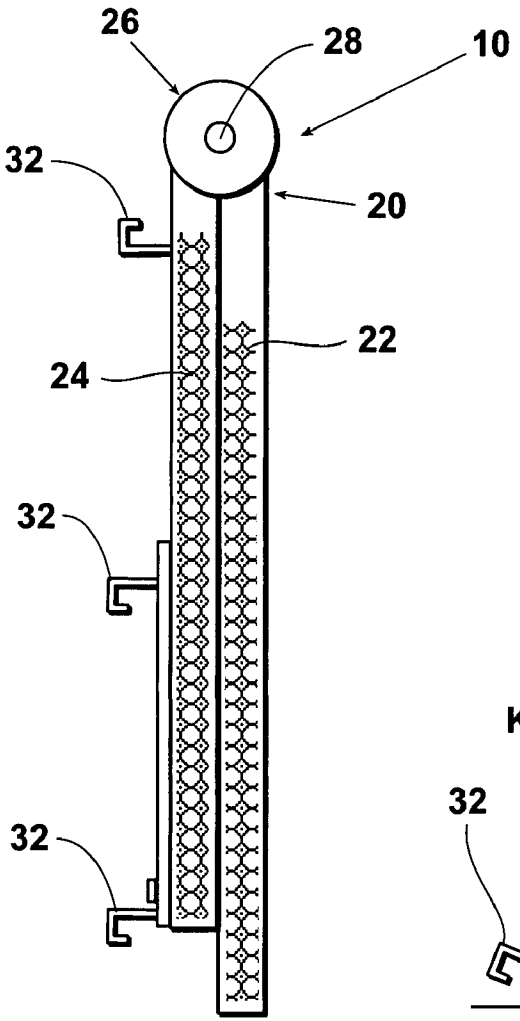
FIG. 9 is a side elevation view of the support structures and center pieces of the leaf catcher of FIG. 1 in folded configuration.

Referring now to FIGS. 1-4, the leaf catcher device of the invention is indicated generally by numeral 10. Leaf catcher 10 is comprised of a plurality of panels foldably connected to one another that are labeled herein as panels A-K. Panels A-K may be connected via "living hinges", i.e. seams formed in plastic panels or by other means. As will be discussed in greater detail below, certain panels are removably affixed to one another, e.g., by Velcro®, snaps, or other means. Preferably, panels A-K may be folded in a flat configuration for ease of storage and movement as shown in FIG. 9. Panels A-K unfold to form an intake area 11 for leaves propelled by a leaf blower, e.g., leaf blower 13 (FIG. 4). Additional advantages associated with the particular construction of the panels A-K will be discussed below. It should be noted that while the application refers primarily to bagging leaves, the leaf catcher of the invention is also suitable for collecting other objects such as grass clippings, trash and other debris.

In an operational or unfolded configuration as shown in FIGS. 1-4, panels A-K are preferably configured as follows. Panels A and A' are hingedly affixed to the end of forwardly extending arms designated generally as 12 and 14. Panels A and A' preferably are folded back towards arms 12 and 14, respectively, to form a stabilizing member and to secure leaf catcher 10 against the ground when leaf blower 13 is employed.

Left and right arms 12, 14 include arm panels B and B'. Arm panels B and B' preferably lean outwardly and are supported in part by support panels A and A'. Arms 12 and 14 additionally include lower transition panels C and C'. Upper arm panels D and D' angle back towards intake area 11. The combination of arm panels B and B' and upper arm panels D and D' form a generally recessed structure for each of left and right arms 12 and 14. Upper transition panels E and E' are provided to communicate with upper arm panels D and D'.

Leaf catcher 10 defines passage 16. Passage 16 is defined by side panels F and F' that communicate with lower opening panel G. Upper panel H communicates with upper transition panels E and E'. Panel H is provided to assist in funneling leaves and other objects through passage 16. Upper opening panel J communicates with a rear edge of panel H and with upper edges or side panels F and F' to enclose passage 16.

Figure 8:
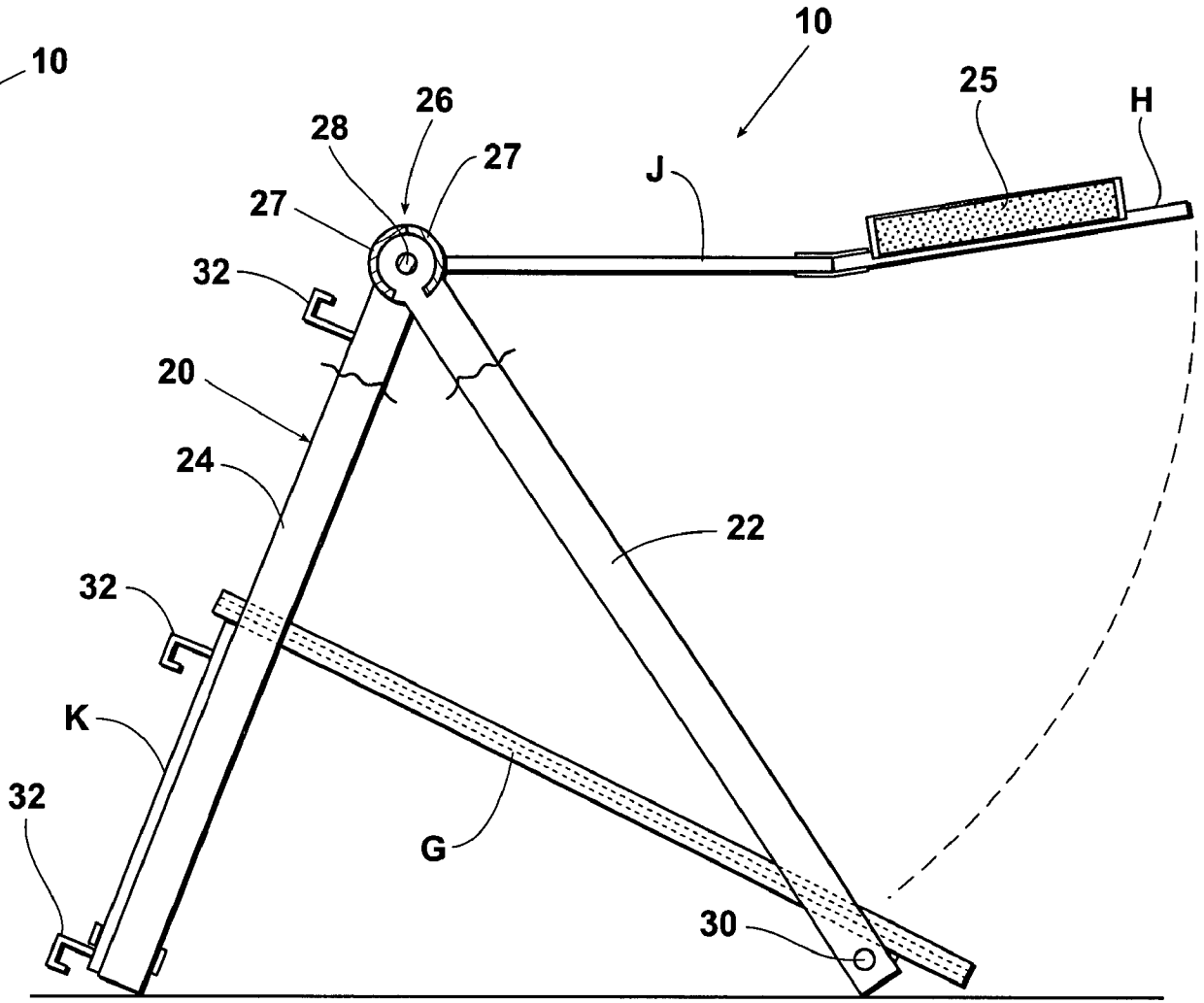
FIG. 8 is a side elevation view of the support structures and center pieces of the leaf catcher of FIG. 1 in an operational "legs extended" configuration.

Panels F, F', G and H, which define passage 16, are supported by a support structure which is designated generally as 20. Referring now in particular to FIGS. 2, 5, 8 and 9, support structure 20 includes forward members 22 and 22' and rearward members 24 and 24'. Forward and rearward members are pivotally connected at hinge members 26 and 26'. Hinge members 26 and 26' are preferably constructed with arcuate members or stops 27 (FIGS. 8, 9) that abut one another when forward members 22, 22' are rotated away from rearward members 24, 24' approximately 30°. Although a separation of forward member 22 from rearward member 24 of approximately 30° is shown in FIG. 8, it should be understood that other angles of separation may be used to provide a stable support structure 20. As can best be seen in FIGS. 1, 4, and 5, forward member 22 and rearward member 24 are connected to forward member 22' and rearward member 24' with upper crossbar 28. Additionally, forward member 22 and rearward member 24 are connected to forward member 22' and rearward member 24' with lower crossbar 30 (FIGS. 2, 8). As can be seen in FIG. 8, upper opening panel J and attached panel H are pivotally connected to upper crossbar 28. Preferably upper opening panel J defines a cut-out area 29 (FIGS. 1, 4) so that upper crossbar 28 may be used as a handle.

Preferably, a plurality of attachment members, such as hooks 32 (FIGS. 2, 8, 9), protrude from a rearward face of rearward members 24 and 24' and from rear panel K. Hooks 32 are used to removably secure catch bag 34.

As can be seen most clearly in FIG. 9, leaf catcher 10 is designed to fold into a substantially flat configuration for ease of storage and transportation. When leaf catcher 10 is desired to be deployed, panels A-J may be easily unfolded from the flat configuration of FIG. 9 to the fully open configuration shown in FIG. 1. To set up leaf catcher 10, first forward members 22 and 22' of support structure 20 are opened with respect to rearward members 24 and 24' of support structure 20. Forward members 22 and 22' are rotated away from rearward members 24 and 24' until stops 27 abut one another to establish a support base as can be seen in FIGS. 2 and 9. Upper opening panel J and attached upper panel H are rotated from their forward location shown in FIG. 9 about upper crossbar 28 to a rearward position adjacent rearward members 24 and 24'.

Figure 1:
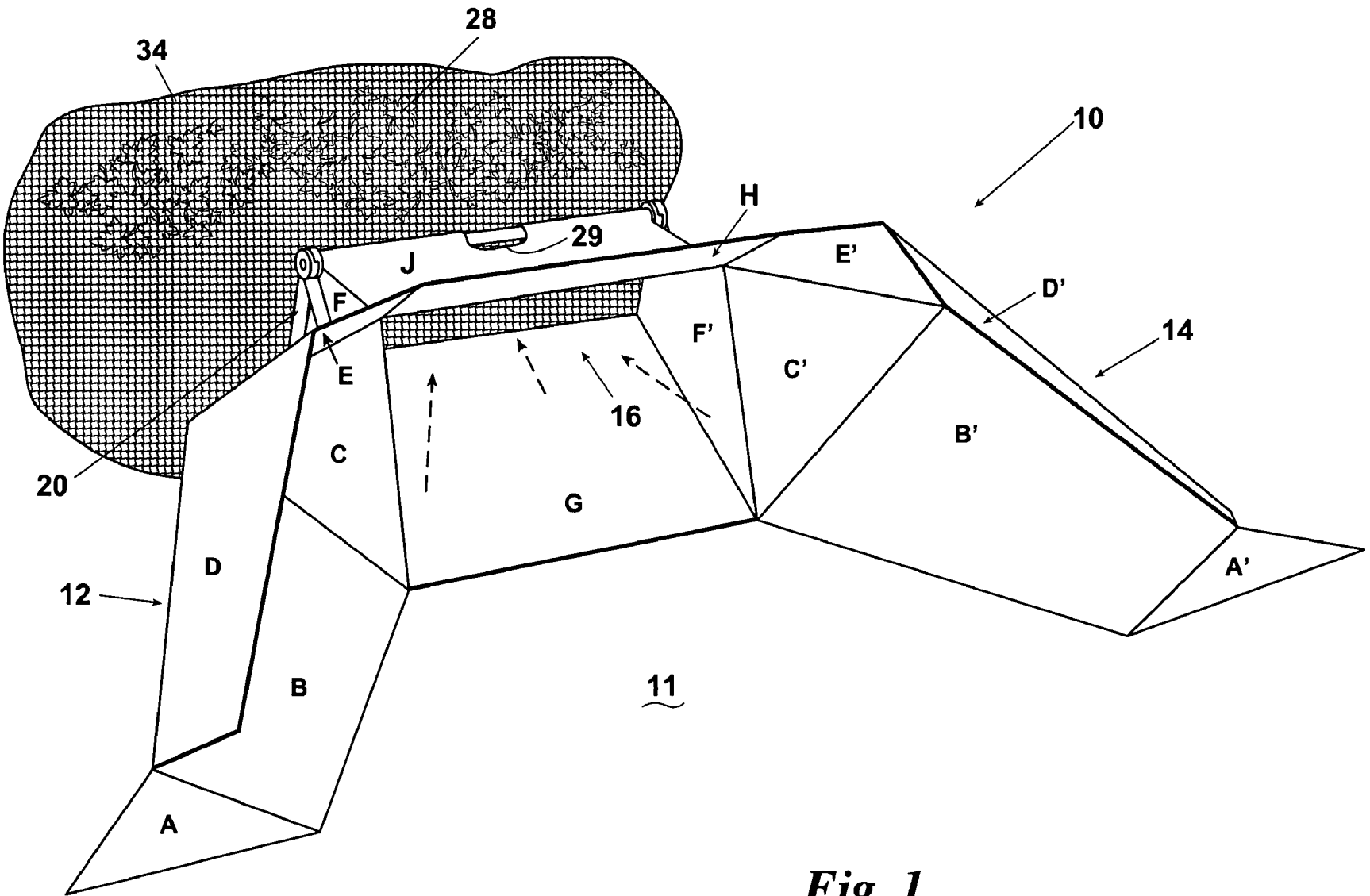
FIG. 1 is a perspective view of the invention showing the leaf catcher in an operational configuration with both sides open.
Figure 2:
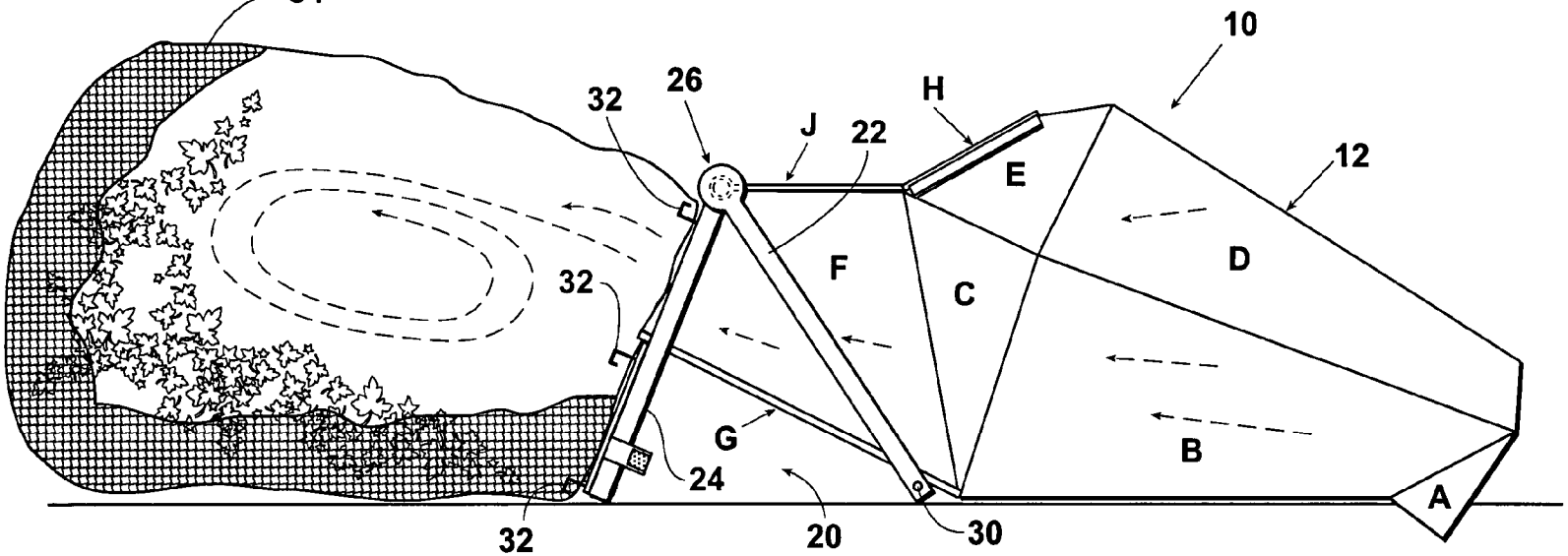
FIG. 2 is a side elevation view of the leaf catcher of FIG. 1.

Left arm 12, which includes support panel A, arm panel B, lower transitional panel C and upper arm panel D, is rotated outwardly from the flat position adjacent forward members 22 and 22' (shown in FIG. 9) to the open configuration shown in FIG. 1. Similarly, right arm 14, which includes support panel A', arm panel B', lower transitional panel C' and upper arm panel D', is transitioned from the flat location adjacent forward members 22 and 22' (shown in FIG. 9) into the open configuration shown in FIG. 1.

Upper opening panel J and attached upper panel H are then rotated back from the temporary location adjacent rearward members 24 and 24' into a forwardly projecting position as shown in FIG. 1. At this time, left and right edges of upper opening J are affixed to upper edges of side panels F and F', e.g. with a fastener such as Velcro® strip 25. Once upper opening panel J has been affixed to upper edges of side panels F and F', left arm 12 and right arm 14 may be adjusted to ensure that arm panels B and B' lean outwardly away from intake area 11. Preferably, arm panels B lean back such that they form approximately a 30° angle with respect to the ground.

Next, upper arm panels D and D' and attached upper transitional panels E and E' are raised so that upper transition panels E and E' may be affixed to upper panel H. Upper arm panels D and adjacent arm panels B then form a generally recessed structure as shown in FIGS. 1, 3 and 4. Once upper arm panels D and D' are in position, then support panels A and A' may be folded outwardly to support arms 12 and 14.

At this time, leaf catcher structure 10 is fully assembled and catch bag 34 may be removably affixed to attachment members, such as hooks 32, provided on rear members 24, 24'. Set up of leaf catcher 10 can easily be completed in less than one (1) minute.

In use, leaf blower 13 may be employed to direct leaves into intake area 11, through passage 16 and into catch bag 34. The configuration of an assembled leaf catcher 10 provides desirable airflow patterns that facilitate efficient leaf collection in catch bag 34. The generally recessed structure associated with arms 12 and 14 results in a spiral or corkscrew-type airflow pattern proximate arms 12 and 14 as shown in FIG. 4. More particularly, leaves adjacent arms 12, 14 are forcefully directed in a corkscrew-type flow path that occurs within intake area 11, which is defined by arm panels B, B' and upper arm panels D, D'. As the leaves progress towards passage 16, they are directed by high velocity airflow from leaf blower 13 in a corkscrew flow path, formed in part by the action of high velocity air from leaf blower 13 along recessed sections of arms 12, 14. The flow path adjacent each of arms 12, 14 creates a vortex for drawing leaves into passage 16 defined by upper opening J, side panels F and lower opening panel G.

A further desirable airflow feature results from the upwardly angled lower surface of passage 16 defined by lower opening panel G. As the high velocity airflow and leaves are ejected from the rear of opening 16, the ramped lower surface, defined by lower opening panel G, results in high velocity airflow directed to the rear of bag 34. As leaves build up at the rear of bag 34, which restricts airflow through the rear of bag 34, leaves are circulated back towards the leaf catcher in a lower portion of the catch bag 34. Rear panel K establishes a rear face for preventing migration of leaves under the ramp formed by lower opening panel G. Additionally, rear panel K provides a boundary to facilitate air circulation within bag 34 and facilitates a substantially dead air space adjacent rear panel K. The effect of the air circulation flow path is that leaves do not back up into passage 16 but instead substantially remain confined within bag 34. A further desirable result of the air circulation path is that leaves tend to be deposited in a substantially even distribution along the portion of the bag that is adjacent to the ground. An even leaf distribution allows for improved filling of the bag and lessens a likelihood that opening 16 will become blocked.

A further desirable airflow feature results from the airflow path within intake area 11. The configuration of arms 12 and 14 results in the leaf catcher 10 being pushed against the ground during use. Support panels A, A' also bear against the ground. Consequently, leaf catcher 10 does not need to be affixed to the ground, either by staking or otherwise.

The construction of catch bag 34 further assists in the ease of collection of leaves. By providing a bag having openings of approximately ½" to ¾", it has been found that the above-described airflows do not tend to cause the leaves to exit bag 34. A suitable bag for use with the leaf catcher of the invention is 35" by 50" long and constructed of woven polypropolene. However, other shapes and materials may also be suitable.

As set forth above, advantages of the leaf catcher 10 of the invention include a unique panel configuration that induces advantageous airflow patterns for directing leaves through passage 16 into catch bag 34. Additionally, the upwardly-sloped bottom surface of passage 16 induces a circulating airflow path within catch bag 34 that has the beneficial effect of maintaining an unobstructed passage 16. Further, downward pressure resulting from the airflow forces the leaf catcher downwards, which results in a self-anchoring effect. This allows the unit to be used on lawns or paved surfaces without having to secure the leaf catcher with stakes or by other means.

Additional advantages include the easily collapsible and expandable panel configuration wherein the leaf catcher of the invention may be collapsed into a substantially flat storage position. A further advantage is the easy assembly of the leaf catcher from the storage position to the operable configuration. The invention is preferably constructed of one (1) piece so there is no assembly required.

The inventive ramp directs debris towards an upper portion of the rear of the catch bag, which is beneficial for preventing clogging of the outlet. Further, the ramp creates a smaller outlet that chokes down the airflow, which increases velocity and aids in the efficient distribution of debris in the bag.

The invention alleviates physical strain by reducing significant stress to the back and knees associated with more conventional methods of bagging leaves. Therefore, the invention is particularly desirable for use by the elderly and/or disabled.

The invention can be used with any standard leaf blower. The invention allows a user to collect leaves in a fraction of the time it takes using conventional leaf gathering tools.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A device for directing leaves into a bag comprising:

a plurality of panels defining a passageway having an entrance and an exit;

a first forwardly extending arm and a second forwardly extending arm, said arms defining an intake area adjacent said entrance to said passageway;

a bag removably affixed adjacent said exit of said passageway, said bag for collecting objects passing through said passageway and for allowing air to escape through openings in said bag;

wherein said plurality of panels includes an upwardly angled lower panel configured such that a lower edge of said upwardly angled lower panel contacts a ground surface and wherein said upwardly angled lower panel extends upwardly from said lower edge with respect to ground surface when the device is in an operational configuration and wherein said entrance to said passageway is larger than said exit of said passageway, said upwardly angled lower panel for inducing circulating airflow in said bag.

2. The device according to claim 1 wherein:

an inside surface of said first forwardly extending arm adjacent said intake area is substantially recessed at predetermined angles; and an inside surface of said second forwardly extending arm adjacent said intake area is substantially recessed at predetermined angles.

3. A device for directing leaves into a bag comprising:

a plurality of panels defining a passageway having an entrance and an exit;

a first forwardly extending arm and a second forwardly extending arm, said arms defining an intake area adjacent said entrance to said passageway;

a bag removably affixed adjacent said exit of said passageway, said bag for collecting objects passing through said passageway and for allowing air to escape through openings in said bag;

wherein said plurality of panels includes an upwardly angled lower panel configured such that a lower edge of said upwardly angled lower panel contacts a ground surface when the device is in an operational configuration and wherein said entrance to said passageway is larger than said exit of said passageway, said upwardly angled lower panel for inducing circulating airflow in said bag;

wherein each of said arms is comprised of a plurality of panels; and wherein said plurality of panels of said arms and said plurality of panels defining said passageway are collapsible into a substantially flat configuration for ease of transport and storage.

4. A device for funneling leaves into a bag comprising:

a plurality of panels defining a passageway having an entrance and an exit;

a first forwardly extending arm and a second forwardly extending arm, said arms defining an intake area adjacent said entrance to said passageway, said intake area defining a space between said first forwardly extending arm and said second forwardly extending arm;

a bag removably affixed to said panels adjacent said exit of said passageway, said bag for collecting objects passing through said passageway and for allowing air to escape through openings in said bag; and wherein said forwardly extending arms have an inside surface adjacent to said intake area wherein said inside surface of said arms form a substantially concave structure about a substantially horizontal axis, said substantially concave inside surfaces of said arms for inducing a corkscrew airflow path for facilitating efficient transfer of objects through said passageway;

wherein said arms are comprised of a plurality of panels; and wherein said plurality of panels of said arms and said plurality of panels defining said passageway are collapsible into a substantially flat configuration for ease of transport and storage.

5. The device according to claim 1 wherein:

each of the forward extending arms said inside define a substantially inwardly pointed apex.

* * * * *